US012697520B2

(12) United States Patent
Parent et al.

(10) Patent No.: US 12,697,520 B2
(45) Date of Patent: Aug. 4, 2026

(54) BAR SHAPING TRAINING APPARATUS

(71) Applicants: James Parent, Mount Pleasant, MI (US); Brett Wargo, Mount Pleasant, MI (US); Carrie Spender, Mount Pleasant, MI (US)

(72) Inventors: James Parent, Mount Pleasant, MI (US); Brett Wargo, Mount Pleasant, MI (US); Carrie Spender, Mount Pleasant, MI (US)

( * ) Notice: Subject to any disclaimer, the term of this patent is extended or adjusted under 35 U.S.C. 154(b) by 44 days.

(21) Appl. No.: 19/045,716

(22) Filed: Feb. 5, 2025

(65) Prior Publication Data

US 2025/0249303 A1 Aug. 7, 2025

Related U.S. Application Data

(60) Provisional application No. 63/550,112, filed on Feb. 6, 2024.

(51) Int. Cl.
*A63B 6/02* (2006.01)

(52) U.S. Cl.
CPC ..... *A63B 6/02* (2013.01)

(58) Field of Classification Search
CPC ..... A63B 17/00; A63B 17/02; A63B 17/04; A63B 6/00; A63B 6/02; A63B 6/025; A63B 21/00047; A63B 21/0005; A63B 21/00054; A63B 21/4027; A63B 21/4029; A63B 21/4037
See application file for complete search history.

(56) References Cited

U.S. PATENT DOCUMENTS

| | | | | |
|---|---|---|---|---|
| 5,217,487 | A * | 6/1993 | Engel | A61H 1/0292 5/624 |
| 8,172,737 | B1 * | 5/2012 | Nihlman | A63B 69/0064 606/240 |
| D683,801 | S * | 6/2013 | Kalina | D21/662 |
| D763,371 | S * | 8/2016 | Fitzgerald | D21/686 |
| 11,007,400 | B1 * | 5/2021 | Stoddard | A63B 21/151 |
| 2015/0051057 | A1 * | 2/2015 | Carter | A63B 21/4037 482/142 |
| 2019/0168062 | A1 * | 6/2019 | Monti | A63B 23/1236 |
| 2021/0154515 | A1 * | 5/2021 | McCalester | A63B 1/005 |

* cited by examiner

*Primary Examiner* — Zachary T Moore
(74) *Attorney, Agent, or Firm* — Dale J. Ream

(57) ABSTRACT

A bar shaping training apparatus for enabling a gymnast to perform bar shaping exercises or drills. The training apparatus may include a base framework having opposed side rails and a plurality of support members extending therebetween. The base framework May include a pad and provides support for other components. The training apparatus may include a core block attached atop the base framework and includes a body member having an upper surface with an upwardly ascending angle. The training apparatus may include an outer cover concentrically larger than the core block and defining an open bottom for covering for receiving the core block therein. At least the core block is constructed of a foam material that provides both resilience and rebounding in use by a gymnast.

18 Claims, 4 Drawing Sheets

BAR SHAPING TRAINING APPARATUS

REFERENCE TO RELATED APPLICATIONS

This is a non-provisional patent application claiming the priority of provisional application 63/550,112 filed Feb. 6, 2024 titled Bar Shaping Training Apparatus which is incorporated herein by reference in its entirety.

BACKGROUND OF THE INVENTION

This invention relates generally to gymnastic training devices and, more particularly, to an apparatus for bar shaping training of a gymnast.

Gymnastics bar shaping training is a critical component of gymnastics that focuses on refining and perfecting body positions while performing skills on the uneven bars. This specialized training is essential for gymnasts to develop strength, flexibility, and control required to execute intricate routines with precision. The significance of bar shaping training plays a crucial role in enhancing performance, reducing the risk of injuries, and fostering overall mastery regarding body positioning.

Gymnastics bar shaping training involves repetitive practice of specific body shapes and positions so as to achieve optimal form during bar routines. This meticulous approach allows gymnasts to refine their techniques ensuring that each movement is executed with precision and grace. The emphasis on body shaping enhances the aesthetic appeal of a gymnastics routine and contributes to higher scores in competitions. Specifically, the bar shaping drills target specific muscle groups, promoting the development of the core, upper body, and lower body strength, while also enhancing flexibility in the shoulders, and back. In addition, proper body shaping on the bars is crucial for injury prevention. A gymnast with correct body alignment and muscle engagement is less likely to experience strains, sprains, or overuse injuries. Through targeted shaping training, gymnasts learn to distribute forces evenly, reducing the impact on vulnerable joints and minimizing the risk of injuries during high-impact maneuvers. Still further, a gymnast needs to master the basics of body shaping to lay the groundwork for complex maneuvers and transitions on the bars, allowing a gymnast to tackle increasingly challenging routines with confidence and competence.

Therefore, it would be desirable to have a bar shaping apparatus having a framework and associated padding that enables a gymnast to specifically engage in bar shaping drills. Further, it would be desirable to have a bar shaping training apparatus that includes a framework bar attached to a steel frame in combination with additional foam mat systems configured for bar shaping exercises. #

SUMMARY OF THE INVENTION

A bar shaping training apparatus according to the present invention includes a base framework having oppositely disposed first and second side rails and respective support members spaced apart from one another extending between the side rails. The apparatus includes a core block having a bottom wall and a block party that has a pair of sidewalls extending upwardly from the bottom wall, the core block having an upper surface extending at a rearwardly ascending angle. The block body defines a channel extending laterally between opposed side walls and at least one of the support members extends through the channel and at least one of the support members is positioned forwardly of a front end of the core block so as to be grasped by a user.

Therefore, a general object of this invention is to provide a bar shaping training apparatus having a wooden or metal bar and associated some mats that enable a gymnast to engage in bar shaping training drills.

Another object of this invention is to provide a bar shaping training apparatus, as aforesaid, having a top mat that may be secured to a T trainer, smart mat system, or base block for additional training options.

Still another object of this invention is to provide a bar shaping training apparatus, as aforesaid, that includes a core block supported atop a base framework and that includes an upper surface having a rearwardly ascending angle.

Yet another object of this invention is to provide a bar shaping training apparatus, as aforesaid, in which the core block is mounted atop a base framework having at least one support member extending between a pair of side rails and, wherein, at least one of the support members is positioned forwardly of a front end of the core block so as to be grasped by a gymnast during training.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
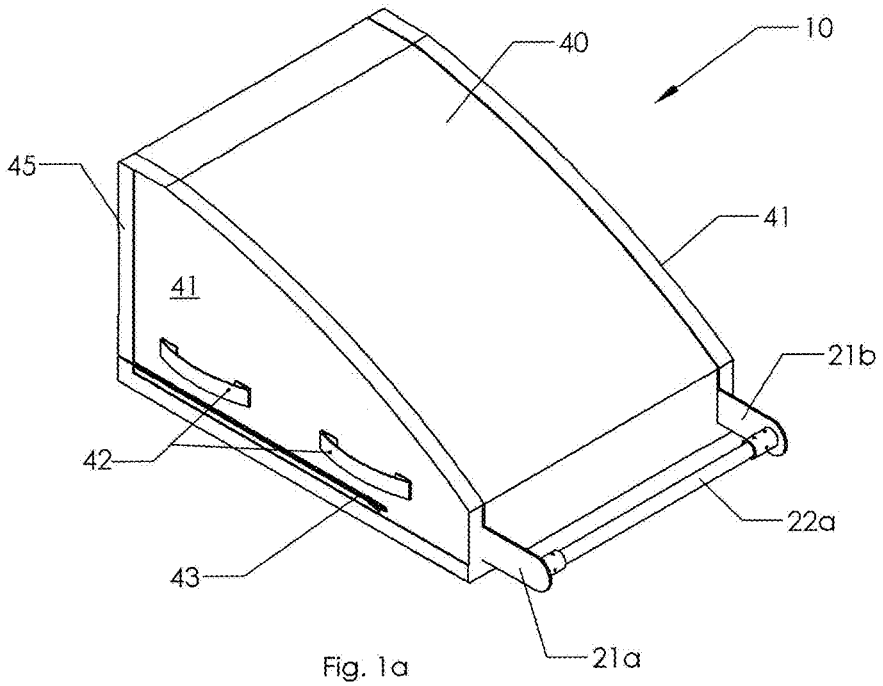
FIG. 1*a* is a front perspective view of a bar shaping training apparatus according to a preferred embodiment of the present invention.
Figure 1B:
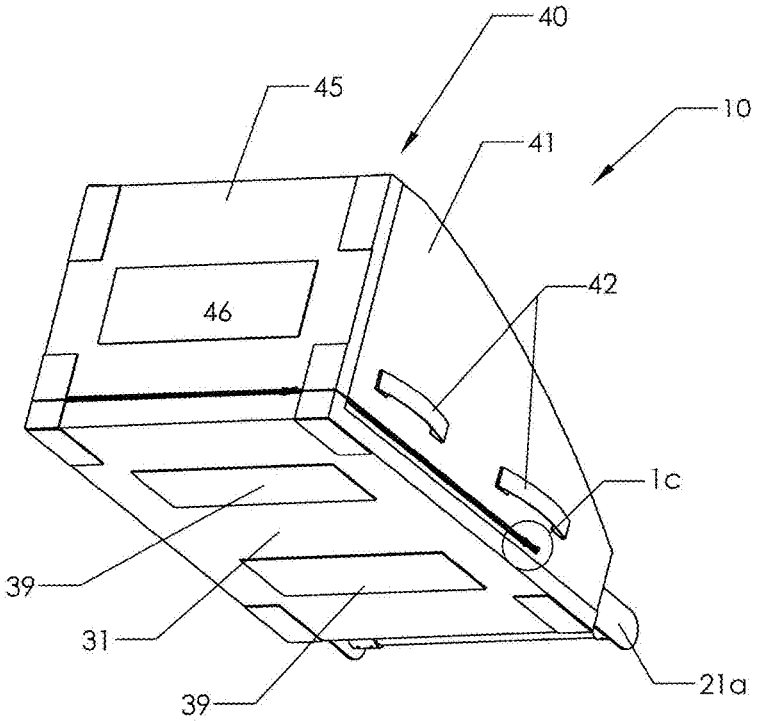
FIG. 1*b* is a perspective view of the training apparatus as in FIG. 1*a;*
Figure 1C:
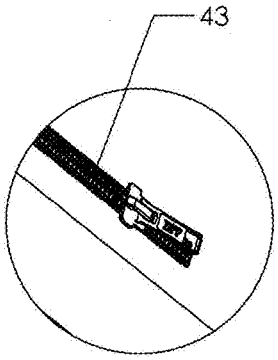
FIG. 1*c* is an isolated view on an enlarged scale taken from FIG. 1*b;*

A bar shaping training apparatus according to a preferred embodiment of the present invention will now be described with reference to the accompanying drawings. The bar shaping training apparatus 10 includes a base framework 20, a core block 30 and an outer cover 40 arranged in such a manner as to enable multiple bar body shaping drills by a gymnast.

The bar shaping training apparatus 10 is built atop and supported by the base framework 20. The base framework 20 may include a first side rail 21*a* and a second side rail 21*b* that is laterally displaced from, parallel to, and opposite the first side rail 21*a*. In an embodiment, a plurality of support members 22 extends between the first and second side rails, the support members being spaced apart from one another such that a robust framework is formed by connection between the side rails and support members. In an embodiment, one or more support members may comprise or include a hook and loop material complementary to other hook and loop material that may be included on an upwardly attached component to enable selectively removable coupling therebetween as will be described in greater detail later. In addition, the plurality of support members 22 may include different constructions and configurations. For example, some support members 22 may have a planar or flattened configuration while other support members may have a tubular or bar-like configuration.

Figure 2:
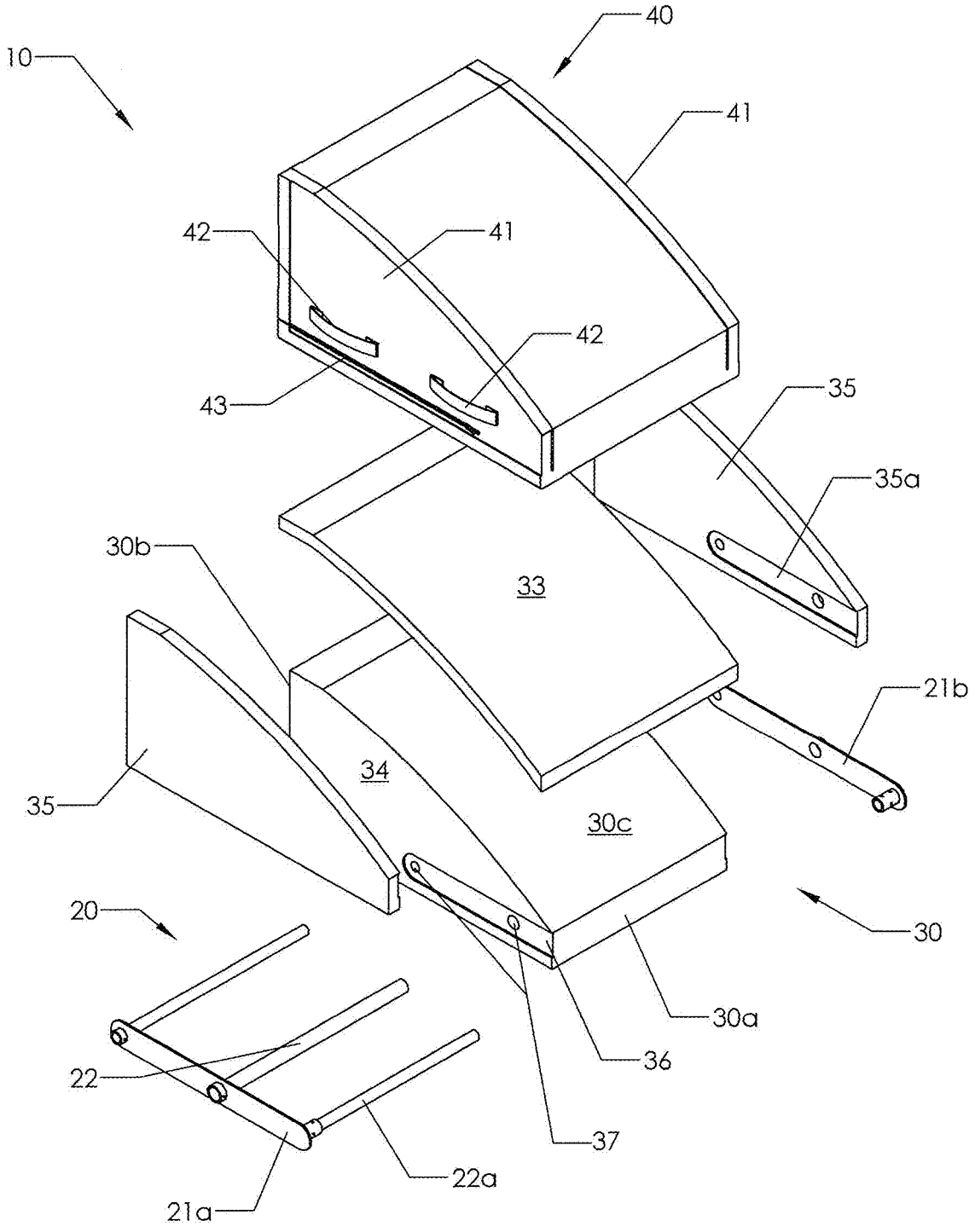
FIG. 2 is an exploded view of the training apparatus as in FIG. 1*a*
Figure 3A:
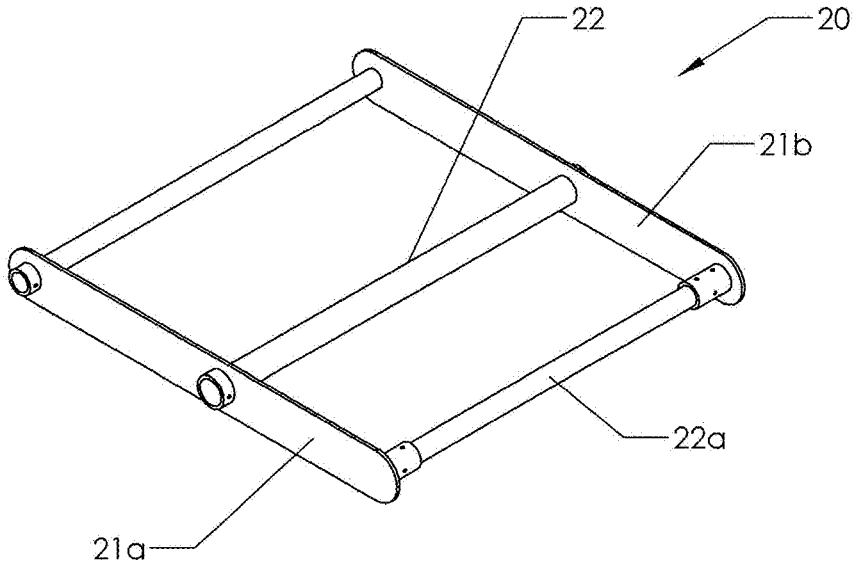
FIG. 3*a* is a perspective view of a base framework illustrated apart from said training apparatus as in FIG. 1*a;*
Figure 3B:
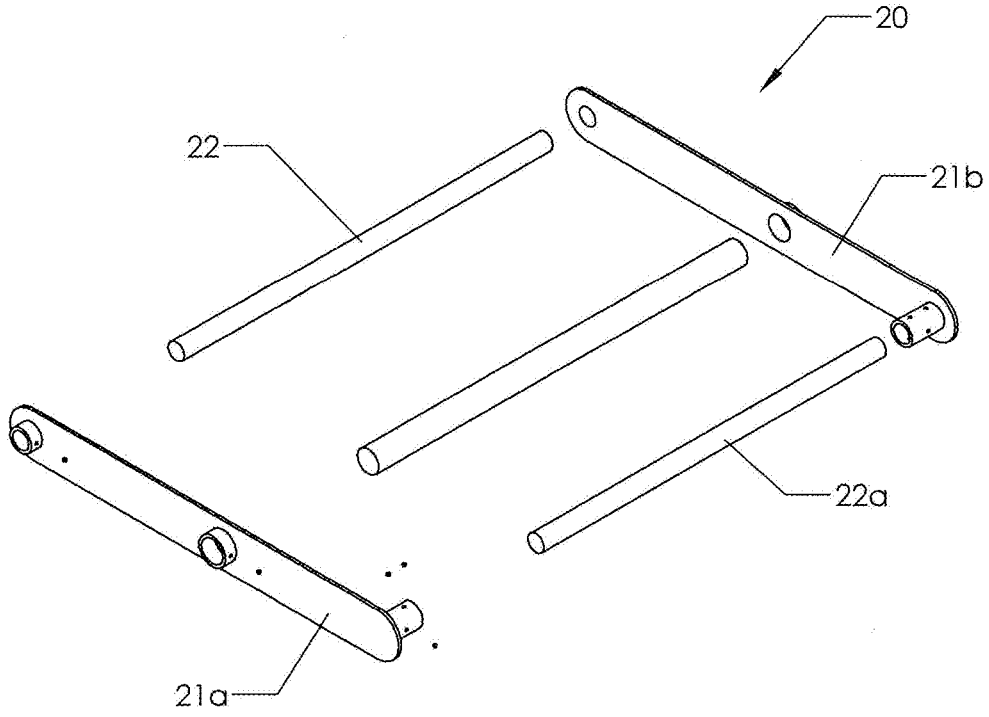
FIG. 3*b* is an exploded view of the base framework as in FIG. 3*a;*

In another aspect, the bar shaping training apparatus 10 may include a core block 30 that may be mounted atop the base framework 20. More particularly, the core block 30 may include a bottom wall 31 having a generally flat or planar surface and a block body 32 that extends upwardly from the bottom wall 31 at a rearwardly ascending angle (FIG. 2). Further, the core block 30 has a front end 30*a* and a rear end 30*b* that is opposite the front and 30*a* and the core block 30 has an upper surface 30*c* that extends in an upward angle from the front end 30*a* extending toward the rear and 30*b* (FIG. 2). In use, the angle of the upper surface 30*c* models to a gymnast a desirable bar shaping position. Stated another way, the core block 30 includes a pair of side walls 34 extending upwardly from the bottom wall 31 and having configurations complementary to the ascending angle of the upper surface 30*c*. In an embodiment, the upper surface 30*c* extends between upper edges of the pair of side walls 34, respectively.

In an embodiment, the core block 30 includes a top pad 33 mounted atop the upper surface 30*c*, the top pad having a configuration that is congruent and complementary to the upper surface. Preferably, both the core block 30 and the top pad 33 have a solid configuration constructed of a its foam material. More particularly, at least the top pad 33 is constructed using EA 30 foam. Ethylene Vinyl Acetate (EVA30) foam is a lightweight foam, generally suited for most applications where a closed cell foam with high rebound and shock deflection is required. EVA foam sheets have high levels of thermal insulation against heat and cold, waterproof properties meaning minimal water absorption and have superb strength and tear resistance. EVA foam is suitable for a wide range of applications such as under spring floors in gymnasiums, yoga blocks, camping mats, pool mats, spa covers and boat fenders/bumpers.

In another critical aspect, the sidewalls 34 each define an inset area 36 adjacent the bottom wall 31, each inset area 36 having a recessed configuration and a configuration that is complementary to the first side rail 21*a* and second side rail 21*b* of the base framework 20, respectively. In other words, the side rails are designed to fit tightly to the sidewalls 34 of the core block 30, all of which will then be hidden or covered by the side pads 35 (FIG. 2).

Further, the core block 30 may include a pair of side pads 35, an inner surface of each side pad being coupled to the side walls 34, such as with glue. Preferably, each side pad 35 constructed of a padded material such as foam Inner surfaces of the side pads 35 may define inset areas 35*a* that are complementary to a configuration of respective side rails of the base framework 20. Also as shown in FIG. 2, the core block 30 defines at least one channel 37 (and preferably a pair of laterally spaced apart channels) that extend between the inset areas 36 on either sidewall 34, each channel 37 being configured to receive a support member 22 when the base framework 20 is coupled to the core block 30.

With further reference to the base framework 20, at least one (and, preferably, two) support member 22 is configured to extend through the at least one channel 37 (and, preferably, two channels) whilst an additional one of the support members 22*a* is positioned forwardly of the front end 30*a* of the core body 32 of the core block 30. In a preferred embodiment, the support member 22*a* that is positioned forward at the front end 30*a* may have a tubular configuration and dimensions indicative of a gymnastics bar. In an embodiment, the support member 22*a* may have a wooden construction.

Figure 4A:
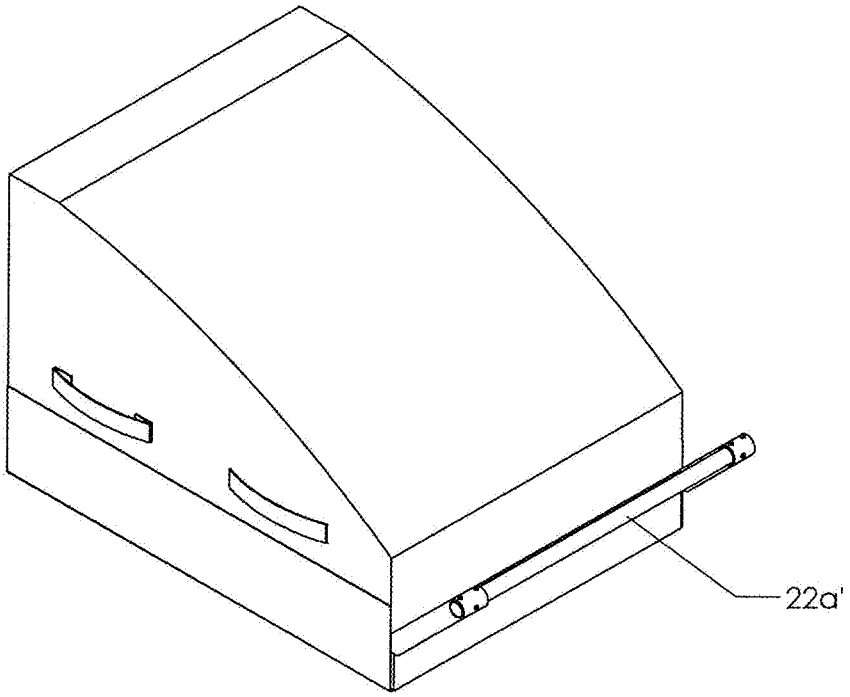
FIG. 4*a* is a front perspective view of a bar shaping training apparatus according to a modified embodiment of the present invention.
Figure 4B:
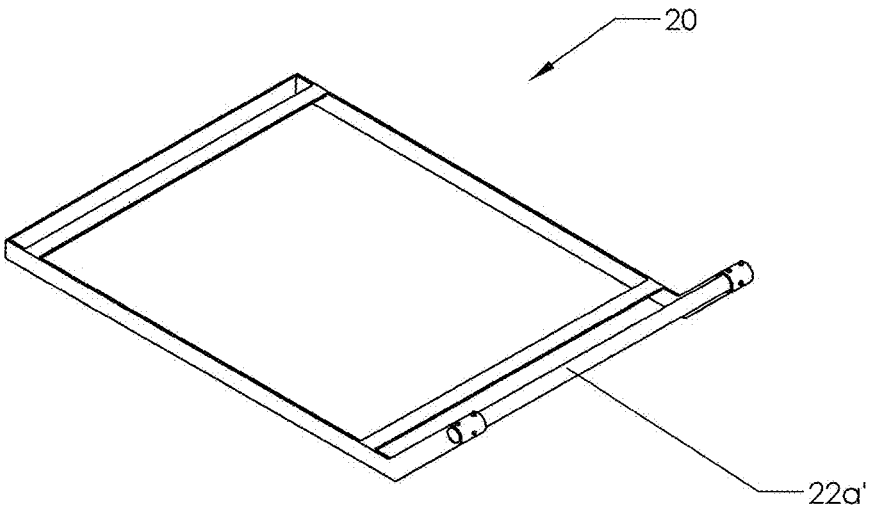
FIG. 4*b* is perspective view of the base framework illustrated apart from the modified training apparatus as in FIG. 4*a.*

In an alternative or modified embodiment (illustrated in FIGS. 4*a* and 4*b*), the forward support member of the framework 20 may have a modified configuration and will, for the sake of clarity, be referred to with a primed reference character 22*a*'. Having a construction that is substantially similar to the forward support member 22*a* described previously, the modified forward support member 22*a*' has a lengthened construction. More particularly, the forward-most portion of the framework 20 itself may have an angled or offset portion and the forward support member 22*a*' extends between forward-most ends of the offset portion. In use, the modified or enhanced surface area that a gymnast may grasp is enhanced when training with the bar shaping apparatus 10.

In another critical aspect, the bar shaping training apparatus 10 may include an outer cover 40 having a configuration so as to cover the core block 30, i.e., the outer cover 40 defines an open bottom such that the core block 30 may be selectively and removably received into the outer cover 40. More particularly, the outer cover 40 may include a pair of sidewalls 41 and a top wall 42 extending between peripheral upper edges of the pair of sidewalls 41. Stated geometrically, the outer cover 40 is concentrically larger and congruent to a configuration of the core block 30 and defines an open bottom so that the core block 30 may be entirely received into an interior area defined by the walls of the outer cover 40.

The bar shaping training apparatus 10 includes a few additional structural details. Namely, each sidewall 41 of the outer cover 40 may include at least one and, preferably, a pair of laterally spaced apart hand straps 42 by which the outer cover 40 may be separated from the core block 30 by a user. Further, there may be a zipper 44 positioned on the outer cover that is also available for securing or releasing the outer cover 40 from the core block 30. In addition, the outer cover 40 may include a rear wall 45 having a non-skid pad 46. Similarly, the bottom wall 31 of the core block 30 may also include at least one non-skid pad 39.

In use, a bar shaping training apparatus enables a gymnast to practice and refine their body positions and transitions between different shapes. More particularly, the bar shaping training apparatus 10 may be oriented in a variety of positions such that an aspiring gymnast may grip the support member 22*a* while the gymnast's body may be suspended in midair or resting atop the top pad 33. With a properly configured apparatus, body shaping exercises can be done slowly so as to teach maintaining good posture and control.

It is understood that while certain forms of this invention have been illustrated and described, it is not limited thereto except insofar as such limitations are included in the following claims and allowable functional equivalents thereof.

The invention claimed is:

1. A bar shaping training apparatus comprising:

a base framework having a first side rail and a second side rail opposite said first side rail and a plurality of support members spaced apart from one another and extending between said first and second side rails;

a core block that includes a bottom wall and a block body having a pair of sidewalls extending upwardly from said bottom wall, said core block having an upper surface situated along upper edges of said side walls and extending at a rearwardly ascending angle;

a top pad situated atop said block body;

wherein said block body defines at least one channel extending laterally between opposed side walls;

wherein at least one of said support members extends through said at least one channel and at least one of said support members is positioned forwardly of a front end of said core block.

2. The bar shaping training apparatus as in claim 1, further comprising an outer cover having a pair of side walls and a top wall extending between peripheral upper edges of said pair of side walls such that the outer cover is concentrically larger and congruent to a configuration of said core block, said outer cover defining an open bottom and open interior area for receiving said core block therein.

3. The bar shaping training apparatus as in claim 2, wherein each sidewall of said outer cover includes at least one hand strap.

4. The bar shaping training apparatus as in claim 1, wherein the core block includes a rear end that is opposite the front end, the upper surface extending in an upward angle from the front end toward the rear end.

5. The bar shaping training apparatus as in claim 1, wherein:

said at least one channel is at least a pair of channels extending laterally between opposed side walls; and at least a pair of said support members extends through said at least a pair of channels of said body member.

6. The bar shaping training apparatus as in claim 1, wherein:

the support member that is positioned forwardly of the front end of said core block is adjacent to said bottom wall; and the support member that is positioned forward of the front end includes a tubular configuration and has dimensions indicative of a gymnastics bar.

7. The bar shaping training apparatus as in claim 1, wherein the sidewalls of the core block each defines an inset area adjacent the bottom wall, each inset area having a recessed configuration that is complementary to a respective side rail of the base framework.

8. The bar shaping training apparatus as in claim 7, wherein said core block includes a pair of side pads each having an inner surface coupled to a respective sidewall as a core block, each said inner surface defining an inset area adjacent the bottom wall, each said inset area having a recessed configuration that is complementary to a respective side rail of the base framework.

9. The bar shaping training apparatus as in claim 1, wherein said core block and said top pad are constructed of Ethylene Vinyl Acetate (EVA) foam having high rebound and shock deflection characteristics.

10. The bar shaping training apparatus as in claim 1, wherein said bottom wall of said core block includes at least one non-skid pad.

11. A bar shaping training apparatus comprising:

a base framework having a pair of oppositely disposed side rails and a plurality of support members spaced apart from one another and extending between said pair of side rails;

a core block coupled to said base framework and extending upwardly therefrom, said core block including a bottom wall and a pair of sidewalls extending upwardly from said bottom wall, said core block having an upper surface situated along upper edges of said side walls and extending at a rearwardly ascending angle;

a top pad situated atop said upper surface; and wherein the core block includes a rear end that is opposite the front end, the upper surface extending in an upward angle from the front end toward the rear end;

wherein the pair of sidewalls of the core block each defines an inset area adjacent the bottom wall, each inset area having a recessed configuration that is complementary to a respective side rail of the base framework.

12. The bar shaping training apparatus as in claim 11, wherein:

said core block defines at least one channel extending laterally between opposed side walls; and at least one of said support members extends through said at least one channel and at least one of said support members is positioned forwardly of a front end of said core block.

13. The bar shaping training apparatus as in claim 12, wherein said core block includes a pair of side pads each having an inner surface coupled to a respective sidewall of the core block, each inner surface defining an inset area adjacent the bottom wall, each said inset area having a recessed configuration that is complementary to a respective side rail of the base framework.

14. The bar shaping training apparatus as in claim 11, wherein said core block and said top pad are constructed of Ethylene Vinyl Acetate (EVA) foam having high rebound and shock deflection characteristics.

15. The bar shaping training apparatus as in claim 11, wherein said bottom wall of said core block includes at least one non-skid pad.

16. The bar shaping training apparatus as in claim 11, further comprising an outer cover having a pair of side walls and a top wall extending between peripheral upper edges of said pair of side walls such that the outer cover is concentrically larger and congruent to a configuration of said core block, said outer cover defining an open bottom and defines an interior area for selectively receiving said core block therein.

17. The bar shaping training apparatus as in claim 16, wherein each sidewall of said outer cover includes at least one hand strap.

18. The bar shaping training apparatus as in claim 11, wherein said core block and said top pad are constructed of Ethylene Vinyl Acetate (EVA) foam having high rebound and shock deflection characteristics.

* * * * *